United States Patent [19]

Kawai et al.

[11] 4,168,680

[45] Sep. 25, 1979

[54] THROTTLE VALVE OPENING CONTROL DEVICE

[75] Inventors: Noriaki Kawai, Okazaki; Heisuke Yamamoto, Toyota, both of Japan

[73] Assignee: Toyota Jidosha Kogyo Kabushiki Kaisha, Aichi, Japan

[21] Appl. No.: 799,921

[22] Filed: May 24, 1977

[30] Foreign Application Priority Data

Mar. 23, 1977 [JP] Japan ..... 52-03104

[51] Int. Cl.[2] ..... F02D 11/08

[52] U.S. Cl. ..... 123/103 R; 123/103 E; 123/124 A; 261/DIG. 11

[58] Field of Search ..... 123/DIG. 11, 97 R, 103 R, 123/103 B, 103 E, 124 R, 124 A, 198 DB; 261/DIG. 18, DIG. 19, 65

[56] References Cited

U.S. PATENT DOCUMENTS

| | | | |
|---|---|---|---|
| 3,721,222 | 3/1973 | Shioya et al. | 123/103 E |
| 3,996,904 | 12/1976 | Kobuki et al. | 123/103 R |
| 4,014,169 | 3/1977 | Omino | 123/97 B |
| 4,060,063 | 11/1977 | Hirasawa | 123/103 R |

*Primary Examiner*—Charles J. Myhre
*Assistant Examiner*—Craig R. Feinberg
*Attorney, Agent, or Firm*—Stevens, Davis, Miller & Mosher

[57] ABSTRACT

Disclosed is a throttle valve opening control device for use in an internal combustion engine. When the throttle valve is rapidly closed after completion of the warm-up of the engine, the throttle valve is temporarily held at a first opening degree which is greater than an idling opening degree and, then, the throttle valve is gradually returned to its idling position. Contrary to this, when the throttle valve is rapidly closed before completion of the warm-up of the engine, the throttle valve is temporarily held at a second opening degree which is greater than said first opening degree and, then, the throttle valve is gradually returned to its idling position.

5 Claims, 2 Drawing Figures

THROTTLE VALVE OPENING CONTROL DEVICE

DESCRIPTION OF THE INVENTION

The present invention relates to a method and a device for controlling the opening operation of the throttle valve of a carburetor in an internal combustion engine.

When the throttle valve of the carburetor is rapidly closed as in the case wherein a vehicle is decelerated, the vacuum level in the intake manifold becomes extremely high. As a result of this, the liquid fuel stuck to the inner wall of the intake manifold is vaporized, whereby an extremely rich air-fuel mixture is fed into the cylinder of the engine. This results in a misfire occurring and, thus, a large amount of unburned HC and CO components is discharged into the exhaust system of the engine. In addition, at this time, if there is a hot spot in the exhaust system of the engine, there occurs a problem in that an after-burn is caused.

In order to prevent an extremely rich air-fuel mixture from being fed into the cylinder of the engine particularly when a vehicle is decelerated, there has been known a throttle valve opening control device in which, when the throttle valve is rapidly closed, the throttle valve temporarily remains opened at a predetermined opening degree and, then, the throttle valve is returned to the idling position. In an engine adopting such a throttle valve opening control device, when the throttle valve is rapidly closed, the vacuum level in the intake manifold does not become so great and, as a result, the air-fuel mixture fed into the cylinder of the engine does not become so rich. As is mentioned above, in a conventional engine, the occurrence of misfire is prevented in such a way that, when the throttle valve is rapidly closed, the throttle valve temporarily remains opened at a predetermined opening degree for a fixed time length, irrespective of whether the warm-up of the engine is completed or not.

However, before completion of the warm-up of the engine, in general, a rich air-fuel mixture is formed in the carburetor and, in addition, satisfactory vaporization of the fuel cannot be obtained since the temperature of the engine is relatively low. As a result of this, a large amount of liquid fuel is stuck to the inner wall of the intake manifold. Consequently, in an engine equipped with a conventional throttle valve opening control device, when a vehicle is decelerated before completion of the warm-up of the engine, even if the throttle valve is returned to the idling position after the throttle valve temporarily remains opened at a predetermined opening degree for a fixed time length, the liquid fuel remains on the inner wall of the intake manifold when the throttle valve is returned to the idling position. This results in a misfire occurring and, as a result, a large amount of unburned HC and CO components is discharged into the exhaust system of the engine, thereby causing an after-burn.

On the other hand, as is known to those skilled in the art, in an engine provided with a catalytic converter used for purifying the exhaust gas, if the temperature of the catalyzer is lower than a predetermined high level, a satisfactory purifying efficiency of the catalyzer cannot be obtained. Consequently, the purifying efficiency is very low before completion of the warm-up of the engine since the temperature of the catalyzer is relatively low. Consequently, even if an engine is provided with a catalytic converter, a large amount of unburned components discharged into the exhaust system when a vehicle is decelerated before completion of the warm-up of the engine cannot be eliminated by the catalytic converter. This results in a large amount of unburned components being discharged into the atmosphere.

As a method for eliminating this disadvantage, there is a method of elongating the length of time during which the throttle valve temporarily remains opened at a predetermined opening degree at the time of deceleration. However, this method causes a problem in that satisfactory effectiveness of engine-braking cannot be obtained when a vehicle is decelerated after completion of the warm-up of the engine.

An object of the present invention is to prevent the occurrence of an after-burn caused at the time before completion of the warm-up of the engine while obtaining good drivability of a vehicle after completion of the warm-up of the engine.

According to the present invention, there is provided a throttle valve control device of an internal combustion engine which has a carburetor with a throttle valve in an intake passage, said device comprising:

vacuum operated control means for temporarily holding the throttle valve at a first opening degree, which is slightly greater than an idling opening degree of the throttle valve when the throttle valve is rapidly closed after completion of the warm-up of the engine, and for temporarily holding the throttle valve at a second opening degree, which is larger than said first opening degree when the throttle valve is rapidly closed before completion of the warm-up of the engine;

a vacuum conduit interconnecting said vacuum operated control means with the intake passage located downstream of the throttle valve;

switching means in said vacuum conduit for selectively interconnecting said vacuum operated control means with either of the intake passage or the atmosphere in response to the temperature of the engine; and a resilient member for urging the throttle valve towards its idling position.

In addition, according to the present invention, there is provided a method for controlling a throttle valve of a carburetor of an internal combustion engine comprising the steps of:

temporarily holding the throttle valve at a first opening degree, which is slightly greater than an idling opening degree of the throttle valve when the throttle valve is rapidly closed after completion of the warm-up of the engine, and temporarily holding the throttle valve at a second opening degree, which is larger than said first opening degree when the throttle valve is rapidly closed before completion of the warm-up of the engine; and gradually returning the throttle valve to its idling position.

The present invention may be more fully understood from the description of preferred embodiments of the invention presented below, together with the accompanying drawings.

DESCRIPTION OF PREFERRED EMBODIMENTS

Figure 1:
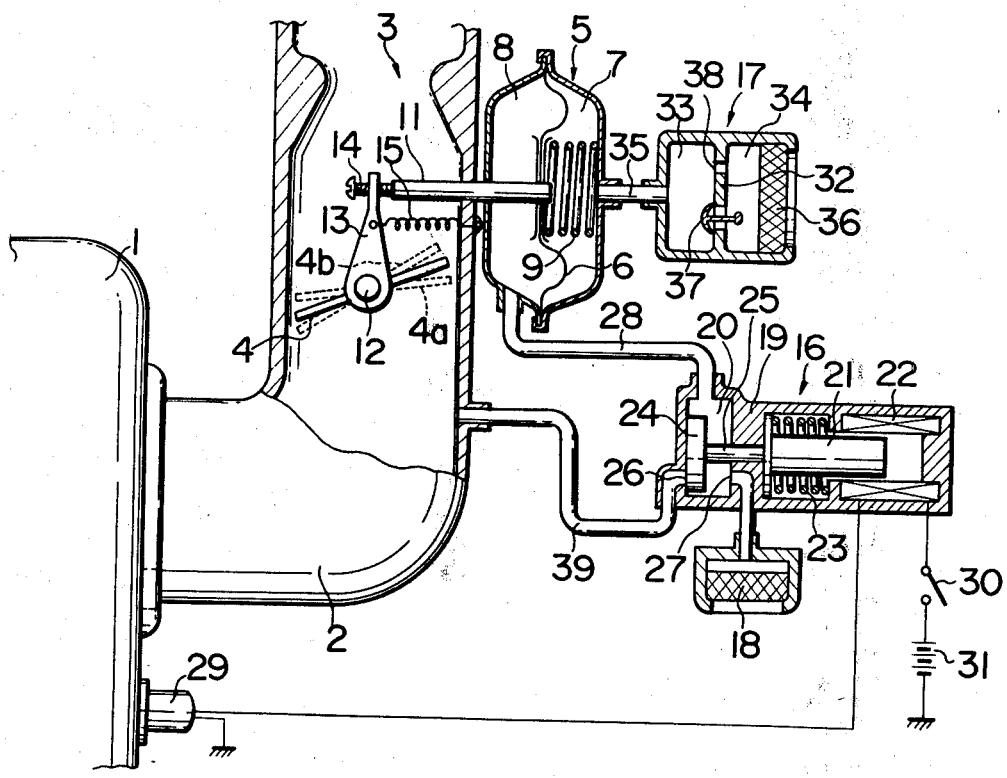
FIG. 1 is a schematic view of an embodiment of a throttle valve opening control device according to the present invention.

Referring to FIG. 1, 1 designates an engine body, 2 an intake manifold, 3 a carburetor, 4 a throttle valve, and 5 a diaphragm apparatus. This diaphragm apparatus has in its housing a damper chamber 7 and a pressure control chamber 8 which are separated by a diaphragm 6. A compression spring 9 is disposed in the damper chamber 7, and the diaphragm 6 is always biased towards the left in FIG. 1 due to the spring force of the compression spring 9. In addition, a control rod 11 passing through the pressure control chamber 8 and extending outwardly from the housing of the diaphragm apparatus 5 is rigidly fixed onto the diaphragm 6. An arm 13 is fixed onto a throttle shaft 12 of the throttle valve 4 so as to rotate together with the throttle valve 4. An adjust screw 14 is screwed into the upper end of the arm 13, and the control rod 11 is so arranged that its tip faces the adjust screw 14. A tension spring 15 is disposed between the arm 13 and the stationary wall of the intake manifold 2 so that the arm 13 is always urged in the clockwise direction in FIG. 1 due to the spring force of the tension spring 15. In FIG. 1, reference numeral 16 designates an electromagnetic switching valve, 17 a delay valve, and 18 an air filter. The electromagnetic switching valve 16 comprises a housing 19, a valve chamber 20 formed in the housing 19, a movable plunger 21 movable in the housing 19, a solenoid 22 serving to attract the movable plunger 21, a compression spring 23 always biasing the movable plunger 21 towards the left in FIG. 1, and a valve head 24 disposed in the valve chamber 20 and connected to the movable plunger 21 via a valve stem 25. A pair of valve ports 26 and 27 arranged to face the valve head 24 open into the valve chamber 20, and this valve chamber 20 is connected to the pressure control chamber 8 of the diaphragm apparatus 5 via a conduit 28. The solenoid 22 of the electromagnetic valve 16 is connected to a temperature detecting switch 29 detecting the temperature of the coolant of the engine on one hand, and to a power source 31 via an ignition switch 30. The temperature detecting switch 29 is turned to the ON condition when the temperature of the coolant of the engine is lowered below a predetermined level, for example 40° C., while the temperature detecting switch 29 is turned to the OFF condition when the temperature of the coolant of the engine is elevated beyond the above-mentioned predetermined level. Consequently, the solenoid 22 remains energized until the time the temperature of the coolant of the engine attains the predetermined level after the engine is started by operating the ignition switch 30 and, as a result, the movable plunger 21 moves towards the right in FIG. 1 due to the attracting force of the solenoid 22. As a result of this, the valve head 24 opens the valve port 26 and closes the valve port 27. Contrary to this, when the temperature of the coolant of the engine is elevated beyond the predetermined level, the solenoid 22 is de-energized and, as a result, the valve head 24 is returned to the position shown in FIG. 1. At this time, the valve head 24 closes the valve port 26 and opens the valve port 27.

The delay valve 17 has in its housing a first chamber 33 and a second chamber 34 which are separated by a partition 32. The first chamber 33 is connected the damper chamber 7 via a conduit 35 and, on the other hand, the second chamber 34 is connected to the atmosphere via an air filter 36. A check valve 37 permitting the outflow of air from the second chamber 34 to the first chamber 33 is mounted on the partition 32 and, in addition, a restricted opening 38 is formed on the partition 32.

The valve port 26 opening into the valve chamber 20 is connected to the intake manifold 2 at a position located downstream off the throttle valve 4, while the valve port 27 opening into the valve chamber 20 is connected to the atmosphere via the air filter 18.

As is mentioned above, when the temperature of the coolant of the engine is higher than the predetermined level, the valve head 24 of the electromagnetic switching valve 16 is in the position shown in FIG. 1. Consequently, at this time, the pressure control chamber 8 of the diaphragm apparatus 5 is connected to the atmosphere and, thus, the pressure in the pressure control chamber 8 is equal to the atmospheric pressure. On the other hand, the pressure in the damper chamber 7 is also equal to the atmospheric pressure.

FIG. 1 shows a moment when the throttle valve 4 is closed after the throttle valve 4 is opened to a great extent and, then, the adjust screw 14 of the arm 13 abuts against the tip of the control rod 11. At this time, the throttle valve 4 is held open at an opening degree which is slightly greater than the idling opening degree shown by the broken line 4*a* in FIG. 1. Then, the control rod 11 is urged towards the right in FIG. 1 due to the spring force of the tension spring 15 and, as a result, the air contained in the damper chamber 7 is gradually discharged into the atmosphere via the restricted opening 38. Consequently, the throttle valve 4 is gradually closed and is returned to the idling position. After this, when the throttle valve 4 is opened, since air can freely enter into the damper chamber 7 from the atmosphere via the check valve 37, the diaphragm instantaneously moves towards the left in FIG. 1 due to the spring force of the compression spring 9 and the control rod 11 projects at its initial position. By communicating the damper chamber 7 with the atmosphere via the restricted opening 38 as is shown in FIG. 1, the throttle valve 4 can be gradually closed from the position shown by the solid line in FIG. 1 to the idling position 4*a* shown by the broken line in FIG. 1.

When the temperature of the coolant of the engine is lower than the predetermined level, the solenoid 22 is energized. Consequently, at this time, the pressure control chamber 8 is connected to the intake manifold 2 via the conduits 28 and 39 and, thus, the vacuum is produced in the pressure control chamber 8. As a result of this, the diaphragm 6 moves towards the left in FIG. 1 and, therefore, the control rod 11 further moves towards the left in FIG. 1 from the position shown by the solid line in FIG. 1. Consequently, when the throttle valve 4 is closed after the throttle valve 4 is opened to a great extent, the throttle valve 4 comes into engagement with the control rod 11 at a position shown by the broken line 4*b* in FIG. 1 and, after this, the throttle valve 4 is gradually returned to the idling position. As is mentioned above, when the temperature of the coolant of the engine is lower than the predetermined level, the opening degree of the throttle valve 4 at the time when the throttle valve 4 comes into engagement with the control rod 11 is greater than in the case wherein the temperature of the coolant of the engine is higher than the predetermined level and, as a result, a large amount of air is introduced into the intake manifold 2. Therefore, in this case, while a large amount of the liquid fuel stuck to the inner wall of the intake manifold 2 is gradually vaporized into the introduced air, the air-fuel mixture fed into the cylinder of the engine, however, does not become excessively rich because a large amount of air is introduced into the intake manifold 2. Then, when he throttle valve 4 is returned to the idling position, almost all of the liquid fuel stuck to the inner wall of the intake manifold 2 has been vaporized and, as a result, there occurs no danger that the air-fuel mixture fed into the cylinder of the engine becomes excessively rich.

Figure 2:
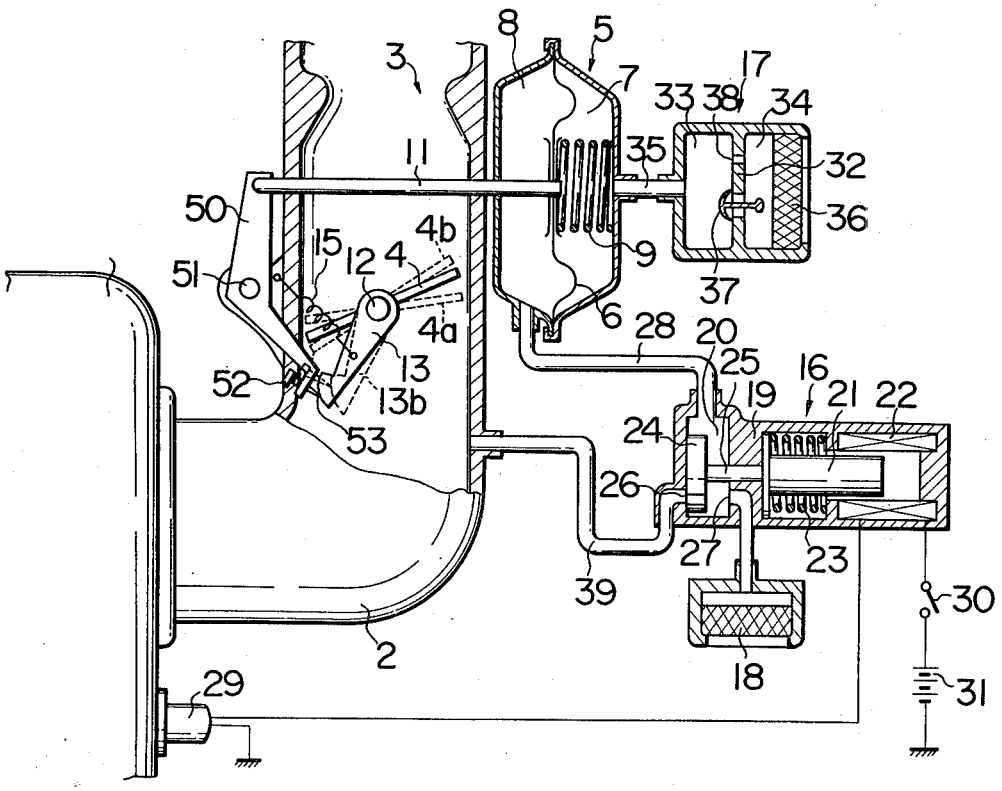
FIG. 2 is a schematic view of an alternative embodiment according to the present invention.

FIG. 2 shows an alternative embodiment according to the present invention. In FIG. 2, similar components are indicated with the same reference numerals as used in FIG. 1. Referring to FIG. 2, a lever 50 is pivotably mounted on the housing of the intake manifold 2 by means of a pivot pin 51, and the tip of the control rod 11 is pivotably connected to the upper end of the lever 50. On the other hand, an adjust screw 52 is screwed into the lower end of the lever 50 and is arranged so as to face a cam face 53 of the arm 13. Consequently, when the throttle valve 4 is closed and the adjust screw 52 abuts against the cam face 53 of the arm 13, the lever 50 slowly rotates in the clockwise direction in FIG. 2 since the arm 13 is urged in the clockwise direction due to the spring force of the tension spring 15. As a result of this, the throttle valve 4 is gradually closed and, then, the adjust screw 52 is disengaged from the cam face 53, whereby the throttle valve 4 is returned to the idling position shown by the broken line 4*a* in FIG. 2. In this embodiment, in the same manner as in the embodiment shown in FIG. 1, the air contained in the damper chamber 7 is gradually pushed out into the atmosphere via the restricted opening 38 due to the spring force of the tension spring 15.

When the temperature of the coolant of the engine is lower than the predetermined level, since the pressure control chamber 8 is connected to the intake manifold 2 in the same manner as in the embodiment in FIG. 1, the vacuum is produced in the pressure control chamber 8. At this time, the control rod 11 moves towards the left in FIG. 2 and, as a result, the adjust screw 52 is positioned at a position shown by the broken line in FIG. 2. On the other hand, the cam face 53 of the arm 13 is so formed that the adjust screw 52 abuts against the cam face 53 of the arm 13 when the adjust screw 52 is positioned at the position shown by the broken line 52' in FIG. 2, and when the throttle valve 4 and the arm 13 are positioned at positions shown by the broken lines 4*b* and 13*b*, respectively. Consequently, when the temperature of the coolant of the engine is lower than the predetermined level, the opening degree of the throttle valve 4 at the time the adjust screw 52 abuts against the cam face 53 of the arm 13 is greater than in the case wherein the temperature of the coolant of the engine is higher than the predetermined level.

In the embodiments shown in FIGS. 1 and 2, the temperature of the coolant of the engine is detected by the temperature detecting switch 29. However, instead of detecting the temperature of the coolant of the engine, any other temperature, such as the temperature of the lubricating oil of the engine, the temperature of the exhaust gas, the temperature of the cylinder block of the engine, the temperature in the engine compartment and the temperature of the fuel, may be detected by the temperature detecting switch 29.

According to the present invention, when the throttle valve is rapidly closed before completion of the warm-up of the engine, an excessively rich air-fuel mixture can be prevented from being fed into the cylinder of the engine. As a result of this, the amount of unburned HC and CO components in the exhaust gas can be reduced and the occurrence of an after-burn can be prevented. In addition, when the throttle valve is rapidly closed after completion of the warm-up of the engine, the throttle valve is temporarily held open at an opening degree which is smaller than in the case wherein the throttle valve is rapidly closed before completion of the warm-up of the engine. As a result of this, a satisfactory effectiveness of an engine-braking can be obtained after completion of the warm-up of the engine.

While the invention has been described by reference to specific embodiments chosen for purposes of illustration, it should be apparent that numerous modifications could be made thereto by these skilled in the art without departing from the spirit and scope of the invention.

What is claimed is:

1. A throttle valve control device of an internal combustion engine which has a carburetor with a throttle valve in an intake passage, said device comprising:

vacuum operated control means for temporarily holding the throttle valve at a first opening degree, which is slightly greater than an idling opening degree of the throttle valve when the throttle valve is rapidly closed after completion of the warm-up of the engine and then gradually returning the throttle valve to said idling opening degree, and for temporarily holding the throttle valve at a second opening degree, which is larger than said first opening degree when the throttle valve is rapidly closed before completion of the warm-up of the engine and then gradually returning the throttle valve to said idling opening degree;

a vacuum conduit interconnecting said vacuum operated control means with the intake passage downstream of the throttle valve;

switching means in said vacuum conduit for selectively interconnecting said vacuum operated control means with either of the intake passage or the atmosphere in response to the temperature of the engine;

said vacuum operated control means comprises a housing, a movable wall disposed in said housing and defining in said housing a first chamber and a second chamber connected to the atmosphere via a restricted opening and a check valve arranged in parallel with said restricted opening and permitting the inflow of air from the atmosphere to said second chamber, a control rod connected to said movable wall and extending through said first chamber, and a spring member disposed in said second chamber and biasing said movable wall towards said first chamber connected to said switching means via said vacuum conduit, said control rod being engageable with the throttle valve for temporarily holding the throttle valve at said first opening degree when said first chamber is connected to the atmosphere and for temporarily holding the throttle valve at said second opening degree when said first chamber is connected to the intake passage; and a resilient member for urging the throttle valve towards its idling position.

2. A throttle valve control device as claimed in claim 1, wherein said movable wall is a diaphragm.

3. A throttle valve control device as claimed in claim 1, wherein an arm is rigidly fixed onto the throttle valve, said control rod being engageable with said arm.

4. A throttle valve control device as claimed in claim 1, wherein an arm having on its end a cam face is rigidly fixed onto the throttle valve, said control rod being connected to one end of a lever pivotably mounted on a stationary pivot pin, the other end of said lever being engageable with said cam face.

5. A throttle valve control device as claimed in claim 1, wherein said switching means comprises an electromagnetic switching valve and a temperature detecting switch detecting the temperature of the engine for energizing said electromagnetic switching valve when the temperature of the engine is lower than a predetermined level.

* * * * *

UNITED STATES PATENT AND TRADEMARK OFFICE

CERTIFICATE OF CORRECTION

PATENT NO. : 4,168,680

DATED : September 25, 1979

INVENTOR(S) : Noriaki KAWAI, et al.

It is certified that error appears in the above-identified patent and that said Letters Patent are hereby corrected as shown below:

Page 1, left column, under item [30], "52-03104" should read -- 52-031104 --.

Signed and Sealed this

*Eleventh* Day of *March 1980*

[SEAL]

*Attest:*

*Attesting Officer*

SIDNEY A. DIAMOND

*Commissioner of Patents and Trademarks*